US009091233B2

(12) United States Patent
Hardman

(10) Patent No.: US 9,091,233 B2
(45) Date of Patent: Jul. 28, 2015

(54) EGR SYSTEM USING DEDICATED EGR CYLINDERS

(71) Applicant: Kenneth E Hardman, Clarkston, MI (US)

(72) Inventor: Kenneth E Hardman, Clarkston, MI (US)

(73) Assignee: FCA US LLC, Auburn Hills, MI (US)

( * ) Notice: Subject to any disclaimer, the term of this patent is extended or adjusted under 35 U.S.C. 154(b) by 79 days.

(21) Appl. No.: 14/094,005

(22) Filed: Dec. 2, 2013

(65) Prior Publication Data

US 2015/0152815 A1 Jun. 4, 2015

(51) Int. Cl.

| | |
|---|---|
| ***F02M 25/07*** | (2006.01) |
| *F02B 75/22* | (2006.01) |
| *F02B 75/18* | (2006.01) |

(52) U.S. Cl.

CPC ..... *F02M 25/0749* (2013.01); *F02B 75/22* (2013.01); *F02B 2075/184* (2013.01); *F02B 2075/1832* (2013.01)

(58) Field of Classification Search

CPC ..... F02M 25/0707; F02M 25/0749; F02B 72/22; F02B 2075/1832; F02B 2075/184

USPC ..... 123/568.11–568.32, 54.7, 54.8

See application file for complete search history.

(56) References Cited

U.S. PATENT DOCUMENTS

| | | | | |
|---|---|---|---|---|
| 6,422,222 | B1 * | 7/2002 | Arbeiter et al. | 123/568.2 |
| 8,291,891 | B2 | 10/2012 | Alger, II et al. | |
| 2005/0028515 | A1 * | 2/2005 | Fukuma et al. | 60/276 |
| 2012/0204845 | A1 * | 8/2012 | Gingrich et al. | 123/568.17 |
| 2012/0298070 | A1 * | 11/2012 | Akinyemi et al. | 123/294 |

* cited by examiner

*Primary Examiner* — Marguerite McMahon
(74) *Attorney, Agent, or Firm* — Ralph E Smith

(57) ABSTRACT

A ninety-degree V-engine having eight or more cylinders can include a first pipe that connects an exhaust port of a first dedicated EGR cylinder bank to an intake manifold and a second pipe that connects an exhaust port of a second dedicated EGR cylinder of a different cylinder bank to the intake manifold, the first and second dedicated EGR cylinders each being one of two consecutive cylinders in a corresponding cylinder bank specified by a specific cylinder firing order.

10 Claims, 2 Drawing Sheets

100
120
Driver Interface
116
Controller
Engine
104
Transmission
112
Drivetrain
108

EGR SYSTEM USING DEDICATED EGR CYLINDERS

FIELD

The present disclosure relates generally to internal combustion engines and, more particularly, to an exhaust gas recirculation (EGR) system using dedicated EGR cylinders.

BACKGROUND

Internal combustion engines (spark ignition engines, diesel engines, homogeneous charge compression ignition (HCCI) engines, etc.) draw air into an intake manifold through an intake system that can be regulated by a throttle. The air in the intake manifold is distributed to a plurality of cylinders and combined with fuel to create an air/fuel mixture that is combusted within the cylinders to drive pistons, which rotatably turn a crankshaft generating drive torque. Exhaust gas resulting from combustion can be expelled from the cylinders into an exhaust manifold. The exhaust gas can then be (i) treated by an exhaust treatment system before being released into the atmosphere, (ii) used to drive a turbocharger for pressurizing air in the intake manifold to increase power output, and/or (iii) recycled into the intake manifold via an external system and then combined with the air to create an air/exhaust gas mixture, which is also known as exhaust gas recirculation (EGR). EGR can be used to improve performance of the internal combustion engine, such as by increasing fuel economy and/or decreasing nitrogen oxide (NOx) emissions.

SUMMARY

In one form, an internal combustion engine is provided in accordance with the teachings of the present disclosure. The engine can include an intake manifold configured to receive air and exhaust gas. The engine can include eight or more cylinders each configured to receive an air/exhaust mixture from the intake manifold through respective intake ports and to expel exhaust gas through respective exhaust ports, wherein the eight or more cylinders are arranged in first and second cylinder banks arranged at approximately a 90 degree angle with respect to each other. The engine can include a first exhaust gas recirculation (EGR) exhaust pipe coupling an exhaust port of a first dedicated EGR cylinder of the first cylinder bank to the intake manifold. The engine can include a second EGR exhaust pipe coupling an exhaust port of a second dedicated EGR cylinder of the second cylinder bank to the intake manifold. The engine can also include one or more exhaust manifolds connected to exhaust ports of a remainder of the eight or more cylinders, the one or more exhaust manifolds being separate from the first and second EGR exhaust pipes. The engine can be configured to operate according to a specific cylinder firing order in which the first and second dedicated EGR cylinders are each preceded by or followed by another cylinder in a same respective cylinder bank. Operating the engine according to the specific cylinder firing order with the first and second dedicated EGR cylinders can decrease exhaust blowdown interference by recirculating exhaust gas from the first and second dedicated EGR cylinders separate from the one or more exhaust manifolds.

Further areas of applicability of the teachings of the present disclosure will become apparent from the detailed description, claims and the drawings provided hereinafter, wherein like reference numerals refer to like features throughout the several views of the drawings. It should be understood that the detailed description, including disclosed embodiments and drawings referenced therein, are merely exemplary in nature intended for purposes of illustration only and are not intended to limit the scope of the present disclosure, its application or uses. Thus, variations that do not depart from the gist of the present disclosure are intended to be within the scope of the present disclosure.

DESCRIPTION

Figure 1:
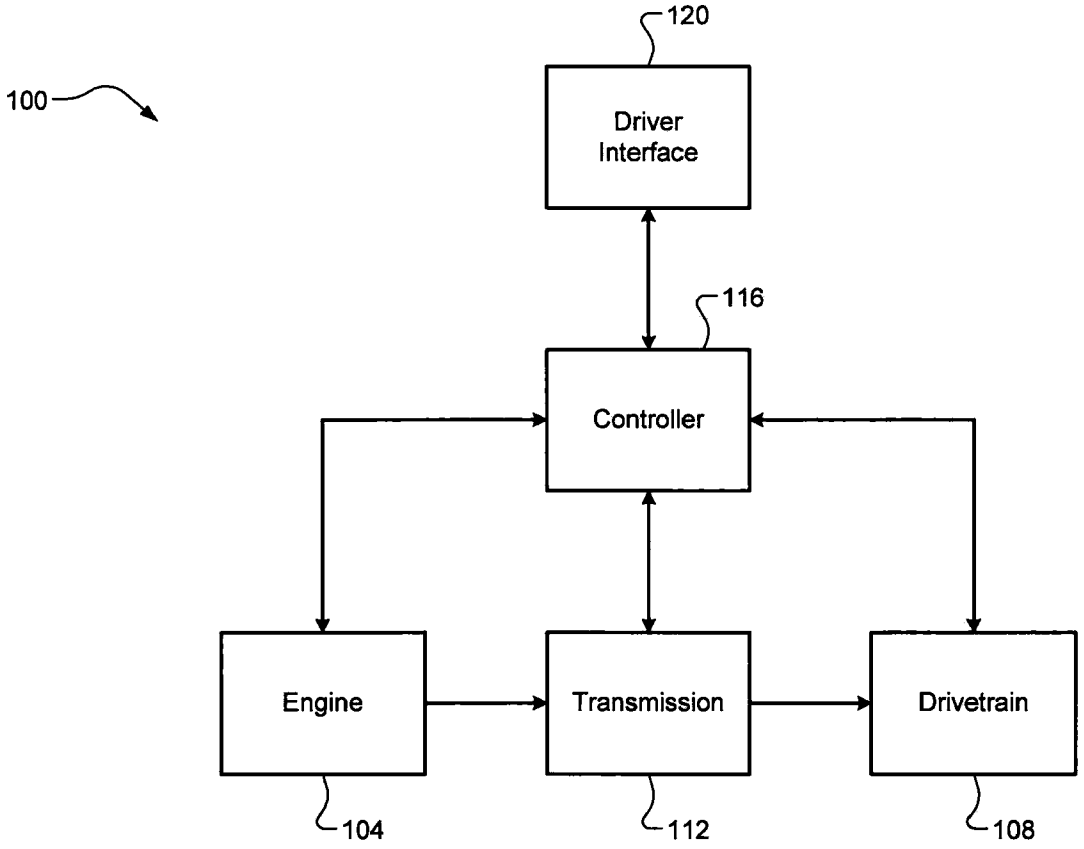
FIG. 1 is a functional block diagram of a vehicle having an internal combustion engine according to the principles of the present disclosure.

Internal combustion engines can have a configuration in which the cylinders are evenly arranged in two distinct cylinder banks such that they appear in the shape of the letter "V" when viewed along an axis of the crankshaft (also known as a "V engine"). For example, the angle between the cylinder banks, i.e., the angle of the "V," may be 90 degrees or approximately 90 degrees (a "90 degree V engine"). Pistons of the engine can be connected to the crankshaft via respective crankpins. Each consecutive crankpin along the crankshaft can be offset from each of its one or more neighboring crankpins by approximately 90 degrees (a "90 degree crankshaft" or "cross-plane crankshaft"). Cross-plane crankshafts can be used for engine balancing and/or to decrease engine vibration, but can also lead to an uneven firing order on each cylinder bank (described in more detail below). Each cylinder bank may have its own components (exhaust manifold, exhaust treatment system, turbocharger, external exhaust gas recirculation (EGR) system, etc.).

The engine can be configured to operate according to a specific firing order of the cylinders (a "cylinder firing order"). In 90 degree V-engines having cross-plane crankshafts and eight or more cylinders, the cylinder firing order can specify two cylinders from each cylinder bank firing consecutively. In such engines, there can be exhaust blowdown interference associated with at least the second cylinder of the two consecutive cylinders of each cylinder bank. More specifically, while both of the two consecutively firing cylinders can experience exhaust blowdown interference, the second of the two consecutively firing cylinders has to exhaust into a higher pressure environment in the exhaust manifold, e.g., high exhaust back pressure (EBP). This can result in the second of the two consecutively firing cylinders in the same cylinder bank doing more pumping work as well as having more residual in-cylinder exhaust, which can decrease performance of the engine. It should be appreciated that the two consecutively firing cylinders of each cylinder bank discussed above can be adjacent cylinders or can be non-adjacent cylinders so long as they are consecutively fired with respect to their corresponding cylinder bank. Other engines, e.g., four and six cylinder engines, do not have or require these unique cylinder firing orders and thus do not experience this unique issue.

Accordingly, techniques for providing dedicated cylinders for EGR are presented for a 90 degree V engine. The techniques can provide for improved EGR performance and decreased EGR system/engine size via more efficient packaging. A 90 degree V-engine having a cross-plane crankshaft and eight or more cylinders can include a first EGR exhaust pipe that connects an exhaust port of a first dedicated EGR cylinder of a first cylinder bank to an intake manifold. Similarly, the engine can include a second EGR exhaust pipe that connects an exhaust port of a second dedicated EGR cylinder of a second cylinder bank to the intake manifold. The first dedicated EGR cylinder and the second dedicated EGR cylinder can each be one of two consecutively firing cylinders in a corresponding cylinder bank specified by a specific cylinder firing order of the engine.

In other words, the first and second dedicated EGR cylinders can each be preceded by or followed by another cylinder in a same respective cylinder bank in the cylinder firing order. In some implementations, the first and second dedicated EGR cylinders can be the second of the two consecutively firing cylinders. In other implementations, the first and second dedicated EGR cylinders can be the first of the two consecutively firing cylinders. In yet other implementations, one cylinder bank can have its dedicated EGR cylinder as the first of its two consecutively firing cylinders, and the other cylinder bank can have its dedicated EGR cylinder as the second of its two consecutively firing cylinders.

Operating the engine according to the specific cylinder firing order can provide for decreased exhaust blowdown interference. In some implementations, the first and second dedicated EGR cylinders may be selected such that the first and second EGR exhaust pipes can be routed to provide for a smaller packaging of the engine. In some implementations, the first and second EGR exhaust pipes can be dedicated EGR exhaust pipes separate from the exhaust manifold(s) of the cylinders for each respective cylinder bank. Furthermore, a method for operating this engine can include operating the engine according to the cylinder firing order, controlling a first EGR valve in response to firing the first dedicated EGR cylinder for the 90 degree V-engine, and controlling a second EGR valve in response to firing the second dedicated EGR cylinder, the first and second EGR valves being configured to regulate a flow of exhaust gas through the first and second EGR exhaust pipes, respectively. The method can provide for decreasing or eliminating exhaust blowdown interference associated with the consecutively firing cylinders of each cylinder bank by providing one of such cylinders as the dedicated EGR cylinder for that cylinder bank of the engine.

Referring now to FIG. 1, a functional block diagram of an exemplary vehicle 100 is illustrated. The vehicle 100 can include an internal combustion engine 104 that generates drive torque. Examples of the engine 104 include a spark-ignition (SI) engine, a diesel engine, and a homogeneous charge compression ignition (HCCI) engine, although it should be appreciated that other suitable engines can be implemented. The drive torque generated by the engine 104 can be transferred to a drivetrain 108 of the vehicle 100 via a transmission 112, and then from the drivetrain 108 to one or more wheels. The drivetrain 108 can include any suitable drivetrain components (a prop shaft differential, a power transfer unit, drive shafts, etc.).

The vehicle 100 can also include a controller 116 that can control operation of the vehicle 100. The controller 116 can include one or more processors and other suitable components (a communication device, memory, etc.). Specifically, the controller 116 can control the engine 104 based on a torque request via a driver interface 120 to achieve a desired drive torque. The driver interface 120 can include any suitable components for interpreting a torque request from the driver of the vehicle, e.g., an accelerator pedal. The controller 116 can also control an EGR system, e.g., EGR valve(s), of the vehicle 100 according to the techniques of the present disclosure, which are described in further detail below.

Figure 2:
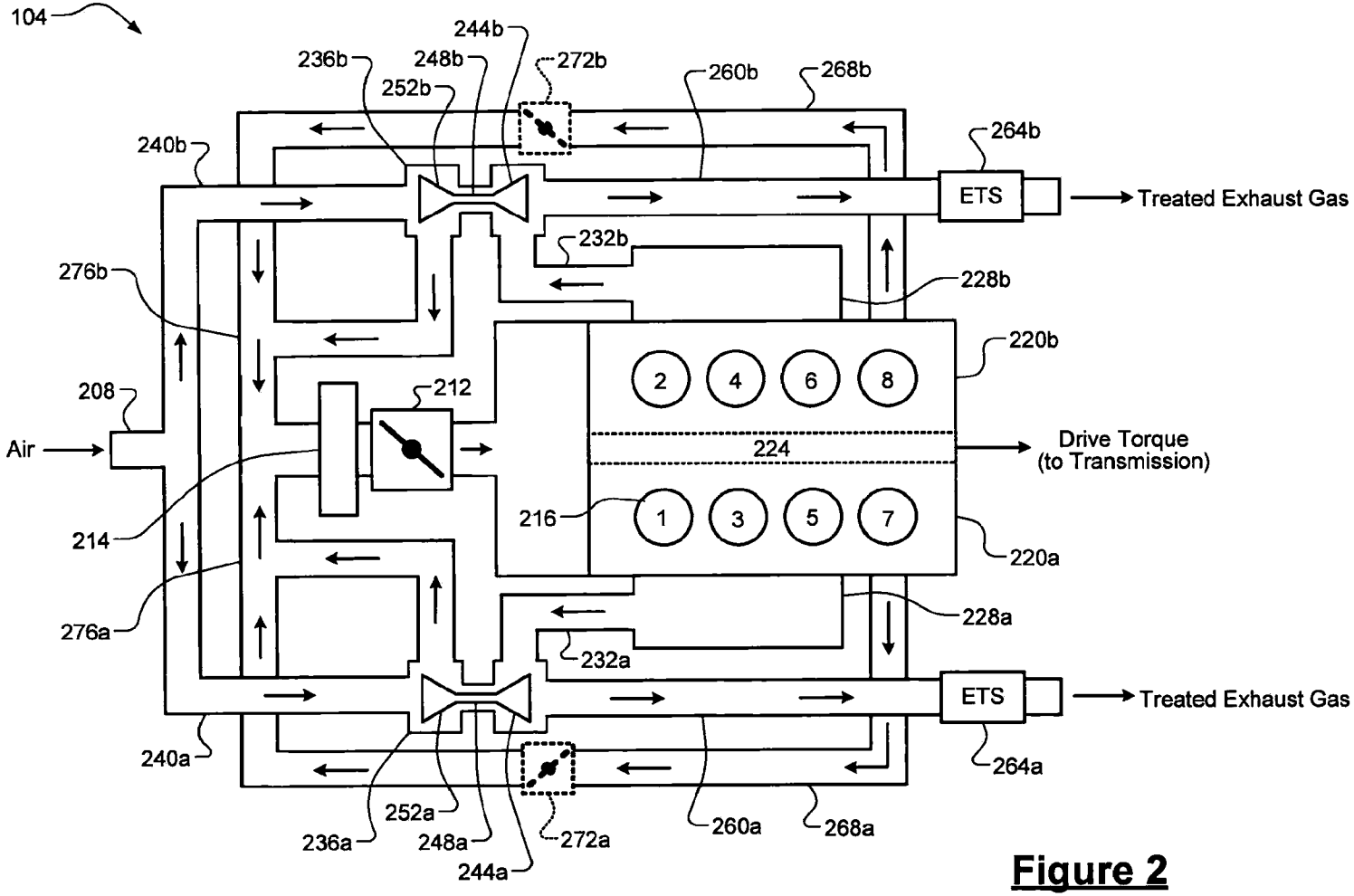
FIG. 2 is a diagram of an example internal combustion engine having dedicated cylinders for exhaust gas recirculation (EGR) according to the principles of the present disclosure.

Referring now to FIG. 2, a diagram of an example of the engine 104 is illustrated. The engine 104 can draw air into an intake manifold 204 through an induction system 208. Airflow into the intake manifold 204 can be regulated by a throttle 212. For example, the throttle 212 may be controlled by the controller 116 (see FIG. 1). When the engine 104 is a forced-induction engine, e.g., a turbocharged engine as shown, the airflow into the intake manifold 204 can also be cooled by an intercooler 214 or another suitable heat exchanger.

The air in the intake manifold 204 can be combined with exhaust gas via EGR, and therefore can also be referred to as an "air mixture" or "air/exhaust mixture." It should be appreciated, however, that the air mixture or air/exhaust gas mixture may include only air, i.e., no exhaust gas, such as when EGR is disabled or not being used. The air mixture in the intake manifold 204 can be distributed to a plurality of cylinders 216-1 . . . 216-8 (collectively "cylinders 216") via intake ports of the respective cylinders 216 and combined with fuel to create an air/fuel mixture. The air/fuel mixture can be compressed and combusted within the cylinders 216 to drive pistons that rotatably turn a crankshaft 224 generating drive torque.

The cylinders 216 can be arranged in two distinct cylinder banks: a first cylinder bank 220*a* and a second cylinder bank 220*b* (collectively "cylinder banks 220"). The engine 104 can be a 90 degree V-engine and thus the cylinder banks 220 can be arranged having an angle of approximately 90 degrees or 90 degrees between them. In one implementation, the crankshaft 224 can be a cross-plane crankshaft. For example only, the crankshaft 224 can be a cross-plane crankshaft in which pistons of the cylinders 216 are attached to the crankshaft 224 by respective crankpins, the crankpins being offset by approximately 90 degrees between cylinders 216-1 and 216-2, cylinders 216-2 and 216-3, cylinders 216-4 and 216-5, cylinders 216-6 and 216-7, and cylinders 216-7 and 216-8, and being offset by approximately 180 degrees between cylinders 216-3 and 216-4 and cylinders 216-5 and 216-6. The cylinders 216 can be associated with hemispherical combustion chambers, e.g., a hemi engine, but it should be appreciated that other suitable combustion chamber configurations can be implemented.

The combustion of the air/fuel mixture within the cylinders 216 can be controlled according to a cylinder firing order. The term "fire" can refer to initiating combustion of the air/fuel mixture, e.g., providing a spark via a spark plug to ignite the compressed air/fuel mixture. The cylinder firing order can specify an order in which to fire each of the eight or more cylinders 216 of the engine 104. The cylinder firing order for a 90 degree V-engine having a cross-plane crankshaft can include two consecutively firing cylinders for each cylinder bank. For example, the cylinder firing order for engine 104 may be:

1, 8, 4, 3, 6, 5, 7, 2, where "1" represents cylinder 216-1, "8" represents cylinder 216-8, and so on. In this cylinder firing order, cylinders 216-5 and 216-7 from cylinder bank 220*a* fire consecutively and cylinders 216-8 and 216-4 from cylinder bank 220*b* fire consecutively.

One of these consecutively firing cylinders from each cylinder bank 220, therefore, can be chosen as a dedicated EGR cylinder. For a dedicated EGR cylinder, all or 100% of its exhaust gas is recirculated back to the intake manifold 204. These combinations could include cylinders 216-4 and 216-5, cylinders 216-4 and 216-7, cylinders 216-5 and 216-8, or cylinders 216-7 and 216-8. One or more of these combinations, however, may be preferred. For example, one of these combinations may provide for a more efficient packaging of the EGR system and thus an overall smaller engine 104 envelope. As shown, cylinders 216-7 and 216-8 are at far right or rear end of the engine 104, which allows for easier piping to their exhaust ports and easier sharing of exhaust manifolds 228*a* and 228*b* by cylinders 216-1/216-3/216-5 and 216-2/216-4/216-6, respectively. It should be appreciated, however, that the most efficient packaging/size configuration may depend on the specific application.

Exhaust gas resulting from combustion can be expelled via the exhaust ports of the respective cylinders 216 into one or more exhaust manifolds. For example, the first exhaust manifold 228*a* receive exhaust gas from cylinders 216-1, 216-3, and 216-5 of the first cylinder bank 220*a*, and the second exhaust manifold 228*b* can receive exhaust gas from cylinders 216-2, 216-4, and 216-6 of the second cylinder bank 220*b*. The exhaust manifolds 228*a* and 228*b* can be collectively referred to as "exhaust manifolds 228." It should be appreciated, however, that a single exhaust manifold could be used for both cylinder banks 220. Operating the engine 104 according to the specific cylinder firing order and using first and second dedicated EGR cylinders can provide for decreased exhaust blowdown interference in the exhaust manifolds 228.

Exhaust gas from the exhaust manifolds 228 can flow through turbocharger exhaust pipes 232*a* and 232*b* to power turbochargers 236*a* and 236*b*, respectively. More specifically, the turbochargers 236*a* and 236*b* can include turbines 240*a* and 240*b*, respectively, which can be rotatably driven by the exhaust gas from the turbocharger exhaust pipes 232*a* and 232*b*, respectively. The turbochargers 236*a* and 236*b* can pressurize air received via turbocharger intake pipes 240*a* and 240*b*, respectively. The turbocharger intake pipes 240*a* and 240*b* can both be connected to the induction system 208, which can intake fresh air. It should be appreciated, however, that each turbocharger intake pipe 240*a* and 240*b* can receive its own fresh air.

The turbines 244*a* and 244*b* can be coupled to compressors 252*a* and 252*b* by shafts 248*a* and 248*b*, respectively. More specifically, the turbines 244*a* and 244*b* can rotatable drive the compressors 252*a* and 252*b* via the shafts 248*a* and 28*b*, respectively. The compressors 252*a* and 252*b* can pressurize the air from the turbocharger intake pipes 240*a* and 240*b*, respectively. The pressurized air can then be provided to the intake manifold 204 after passing the intercooler 214 and the throttle 212. The exhaust gas from the turbochargers 236 can flow through exhaust pipes 260*a* and 260*b* to be treated by exhaust treatment systems (ETS) 264*a* and 264*b*, respectively, before being released into the atmosphere. Example components of ETS 264*a* and ETS 264*b* can include catalytic converters, selective catalytic reduction systems, lean NOx traps, and particulate matter filters, but other suitable components could also be implemented.

The dedicated EGR cylinders, e.g., cylinders 216-7 and 216-8, can provide EGR to the intake manifold 204. More specifically, cylinder 216-7 can have a first exhaust EGR exhaust pipe 268*a* that connects its exhaust port to the intake manifold 204 and cylinder 216-8 can have a second EGR exhaust pipe 268*b* that connects its exhaust port to the intake manifold 204. As discussed above, EGR exhaust pipes 268*a* and 268*b* can be separate from exhaust manifolds 228*a* and 228*b*. Optionally, the flow of exhaust gas through the first EGR exhaust pipe 268*a* and the second exhaust pipe 268*b* can be controlled by a first EGR valve 272*a* and a second EGR valve 272*b*, respectively. In other words, the dedicated EGR cylinders 216-7 and 216-8 may recirculate exhaust gas directly into the intake manifold 204 via their respective EGR exhaust pipes without impedance or regulation by EGR valves. The first and second optional EGR valves 272*a* and 272*b* may be controlled by the controller 116 (see FIG. 1).

By using one of the consecutively firing cylinders of each cylinder bank as the dedicated EGR cylinder, all exhaust gas is routed through separate EGR piping, e.g., EGR exhaust pipes 268*a* and 268*b*, and thus does not interfere with the other of the consecutively firing cylinders' exhaust gas in the exhaust manifold(s). In some implementations, the first and second EGR exhaust pipes 268*a* and 248*b* can converge with pipes carrying the pressurized air output by the turbochargers 236*a* and 236*b* at points 276*a* and 276*bb*, respectively, thereby sharing a common path to the intake manifold 204. It should be appreciated, however, that the first and second EGR exhaust pipes 268*a* and 268*b* can be connected to the intake manifold 204 at distinct locations in comparison to the locations where the turbocharger exhaust pipes 232*a* and 232*b* are connected to the intake manifold 204.

It should be appreciated that the engine 104 may include a single exhaust manifold and/or a single exhaust pipe/EGR valve. For example, the non-dedicated EGR cylinders could all expel exhaust gas into the single exhaust manifold, which could then be treated by a single exhaust treatment system. Similarly, for example, the dedicated EGR cylinders 216-7 and 216-8 could recirculate exhaust gas via a single EGR exhaust pipe, which may be regulated by the single EGR valve. In the single EGR exhaust pipe and single EGR valve implementation, a single turbocharger could be used. As previously mentioned, however, this single EGR valve is also optional. Further, it should be appreciated the engine 104 could be implemented using a different type of forced induction, e.g., a supercharger, or the engine 104 could be naturally-aspirated.

It should be understood that the mixing and matching of features, elements, methodologies and/or functions between various examples may be expressly contemplated herein so that one skilled in the art would appreciate from the present teachings that features, elements and/or functions of one example may be incorporated into another example as appropriate, unless described otherwise above.

What is claimed is:

1. An internal combustion engine, comprising:

an intake manifold configured to receive air and exhaust gas;

eight or more cylinders each configured to receive an air/exhaust mixture from the intake manifold through respective intake ports and to expel exhaust gas through respective exhaust ports, wherein the eight or more cylinders are arranged in first and second cylinder banks arranged at approximately a 90 degree angle with respect to each other;

a first exhaust gas recirculation (EGR) exhaust pipe coupling an exhaust port of a first dedicated EGR cylinder of the first cylinder bank to the intake manifold;

a second EGR exhaust pipe coupling an exhaust port of a second dedicated EGR cylinder of the second cylinder bank to the intake manifold; and one or more exhaust manifolds connected to exhaust ports of a remainder of the eight or more cylinders, the one or more exhaust manifolds being separate from the first and second EGR exhaust pipes;

wherein the engine is configured to operate according to a specific cylinder firing order in which the first and second dedicated EGR cylinders are each preceded by or followed by another cylinder in a same respective cylinder bank; and wherein operating the engine according to the specific cylinder firing order with the first and second dedicated EGR cylinders decreases exhaust blowdown interference by recirculating exhaust gas from the first and second dedicated EGR cylinders separate from the one or more exhaust manifolds.

2. The engine of claim 1, wherein the first cylinder bank includes the first dedicated EGR cylinder, a first cylinder, a third cylinder, and a fifth cylinder, and wherein the second cylinder bank includes the second dedicated EGR cylinder, a second cylinder, a fourth cylinder, and a sixth cylinder.

3. The engine of claim 2, wherein the engine includes a front side and an opposed rear side, and wherein the first and second dedicated EGR cylinders are both located at the rear side of the engine.

4. The engine of claim 2, wherein the first cylinder bank is arranged, from a front of the engine to a rear of the engine, as the first cylinder, the third cylinder, the fifth cylinder, and the first dedicated EGR cylinder, and wherein the second cylinder bank is arranged, from a front of the engine to a rear of the engine, as the second cylinder, the fourth cylinder, the sixth cylinder, and the second dedicated EGR cylinder.

5. The engine of claim 2, wherein the first cylinder bank is arranged, from a front of the engine to a rear of the engine, as the first cylinder, the third cylinder, the first dedicated EGR cylinder, and the fifth cylinder, and wherein the second cylinder bank is arranged, from a front of the engine to a rear of the engine, as the second cylinder, the second dedicated EGR cylinder, the fourth cylinder, and the sixth cylinder.

6. The engine of claim 4, wherein the specific cylinder firing order is the first cylinder, the second dedicated EGR cylinder, the fourth cylinder, the third cylinder, the sixth cylinder, the fifth cylinder, the first dedicated EGR cylinder, and the second cylinder.

7. The engine of claim 6, wherein all of the exhaust gas from the first and second dedicated EGR cylinders is recirculated to the intake manifold independent of the one or more exhaust manifolds.

8. The engine of claim 1, further comprising first and second EGR valves configured to control a flow of exhaust gas through the first and second EGR exhaust pipes, respectively, and into the intake manifold.

9. The engine of claim 1, further comprising a cross-plane crankshaft.

10. The engine of claim 1, wherein the eight or more cylinders comprise ten cylinders.

* * * * *